US007564194B2

(12) United States Patent
Jang et al.

(10) Patent No.: US 7,564,194 B2
(45) Date of Patent: Jul. 21, 2009

(54) METHOD FOR DETECTING LAMP CURRENT AND LAMP DRIVING CIRCUIT USING THE METHOD FOR DETECTING THE LAMP CURRENT

(75) Inventors: Hyeon-Yong Jang, Osan-si (KR); Seong-Sik Choi, Seoul (KR); Du-Hwan Chung, Suwon-si (KR); Moon-Shik Kang, Seongnam-si (KR); Song-Yi Han, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 13 days.

(21) Appl. No.: 11/777,450

(22) Filed: Jul. 13, 2007

(65) Prior Publication Data

US 2008/0024073 A1 Jan. 31, 2008

(30) Foreign Application Priority Data

Jul. 14, 2006 (KR) ..... 10-2006-0066405

(51) Int. Cl.
*G05F 1/00* (2006.01)

(52) U.S. Cl. ..... 315/291; 315/224; 315/282; 315/307; 315/209 R; 345/102; 363/78

(58) Field of Classification Search ..... 315/209 R, 315/224, 276, 278, 282, 291, 307; 345/52, 345/87, 102, 212; 363/40, 41, 78
See application file for complete search history.

(56) References Cited

U.S. PATENT DOCUMENTS

| | | | | |
|---|---|---|---|---|
| 6,812,916 | B2 * | 11/2004 | Hwang | 345/102 |
| 6,870,330 | B2 * | 3/2005 | Choi | 315/307 |
| 7,148,633 | B2 * | 12/2006 | Yu et al. | 315/224 |
| 7,282,871 | B1 * | 10/2007 | Kim et al. | 315/291 |
| 7,394,209 | B2 * | 7/2008 | Lin et al. | 315/247 |
| 7,411,360 | B2 * | 8/2008 | Henry | 315/307 |
| 7,446,485 | B2 * | 11/2008 | Huang | 315/277 |

FOREIGN PATENT DOCUMENTS

| | | | |
|---|---|---|---|
| JP | 2004-355859 | A | 12/2004 |
| KR | 1020010029114 | A | 4/2001 |
| KR | 1020040000802 | A | 1/2004 |

* cited by examiner

*Primary Examiner*—Haissa Philogene
(74) *Attorney, Agent, or Firm*—Cantor Colburn LLP

(57) ABSTRACT

A lamp driving circuit includes: a voltage supply part including a first voltage supply part and a second voltage supply part; a first circuit part including a first terminal, a second terminal and a first coil; a second circuit part including a second coil electromagnetically coupled to the first coil and which supplies a voltage to a lamp; and an electric current detecting part which detects an electric current of the first coil and includes a detecting resistor and an electric current detector.

15 Claims, 9 Drawing Sheets

METHOD FOR DETECTING LAMP CURRENT AND LAMP DRIVING CIRCUIT USING THE METHOD FOR DETECTING THE LAMP CURRENT

This application claims priority to Korean Patent Application No. 2006-66405, filed on Jul. 14, 2006, and all the benefits accruing therefrom under 35 U.S.C. § 119, the contents of which in its entirety are herein incorporated by reference.

BACKGROUND OF THE INVENTION

1. Field of the Invention

The present invention relates to a method for detecting a lamp current and a lamp driving circuit using the method for detecting the lamp current. More particularly, the present invention relates to a method for detecting a lamp current of a coil which drives a lamp and a lamp driving circuit using the method for detecting the lamp current.

2. Description of the Related Art

In general, a cold cathode fluorescent lamp ("CCFL") is used as a backlight in a large-screen liquid crystal display ("LCD") monitor or an LCD television receiver set. The backlight of the large-screen LCD monitor or the LCD television receiver set includes a current detecting device to protect the CCFL.

However, the conventional current detecting device requires an additional transformer for detecting an electric current in a second coil, as well as an integration circuit for using the detected current to protect the CCFL.

BRIEF SUMMARY OF THE INVENTION

Exemplary embodiments of the present invention provide a method for easily and accurately detecting a lamp current without additional circuits and/or components, and a lamp driving circuit using the method.

In one exemplary embodiment of the present invention, a method for detecting a lamp current includes electrically connecting a first end portion of a first coil to a first supply voltage, electrically connecting a second end portion of the first coil to a second supply voltage, the first coil being electromagnetically coupled to a second coil driving a lamp, electrically connecting the first and second end portions of the first coil at a contact point, connecting the contact point to ground, and detecting an electric current flowing from the contact point to ground.

The electric current flowing from the contact point to ground may be detected by installing a resistor between the contact point and ground and detecting an electric current flowing through the resistor.

The first supply voltage and the second supply voltage may be controlled based on the detected electric current of the electric current detecting part, for example, but is not limited thereto.

The controlling of the first supply voltage and the second supply voltage may include installing a first switch at a first voltage supply part which supplies the first supply voltage, a second switch at a second voltage supply part which supplies the second supply voltage, a third switch at the first end portion of the first coil and a fourth switch at the second end portion of the first coil to control the first supply voltage and the second supply voltage according to the detected current by using the first, second, third and fourth switches.

The controlling of the first supply voltage and the second supply voltage according to the detected current by using the first, second, third and fourth switches may include reducing a switching-on time of the first supply voltage and the second supply voltage when the detected electric current is greater than a predetermined value by using the first, second, third and fourth switches, and increasing the switching-on time of the first supply voltage and the second supply voltage by using the first, second, third and fourth switches when the detected electric current is less than the predetermined value.

In another exemplary embodiment of the present invention, a lamp driving circuit includes a voltage supply part including a first voltage supply part and a second voltage supply part, and a first circuit part including a first terminal, a second terminal and a first coil. A first end portion of the first coil is electrically connected to the first voltage supply part through the first terminal and a second end portion of the first coil is electrically connected to the second voltage supply part through the second terminal.

The lamp driving circuit further includes a second circuit part including a second coil electromagnetically coupled to the first coil and which supplies a voltage to a lamp and an electric current detecting part. The electric current detecting part detects an electric current of the first coil and includes a detecting resistor having a first end portion and a second end portion and an electric current detector. The first end portion of the detecting resistor is electrically connected to the first and second terminals of the first circuit part and the electric current detector and the second end portion of the detecting resistor is electrically connected to ground.

A supply voltage of the first voltage supply part and a supply voltage of the second voltage supply part of the voltage supply part may be alternating current ("AC") voltages having phases opposite to each other.

The lamp driving circuit may further include a supply voltage control part. The supply voltage control part may be electrically connected between the electric current detecting part and the voltage supply part and may control the first supply voltage and the second supply voltage.

The lamp driving circuit may further include a first switch installed between the first voltage supply part and the first terminal, a second switch installed between the second voltage supply part and the second terminal, a third switch installed between the first terminal and the first end portion of the detecting resistor and a fourth switch installed between the second terminal and the first end portion of the detecting resistor to control the first supply voltage and the second supply voltage. The first voltage supply part and the second voltage supply part of the voltage supply part may include direct current ("DC") voltage sources.

The lamp driving circuit may further include a supply voltage control part electrically connected to the first, second, third and fourth switches to control the first supply voltage and the second supply voltage.

A plurality of the second coils of the second circuit part may be electromagnetically coupled to the first coil. The lamp of the second circuit part may include a cold cathode fluorescent lamp ("CCFL").

In still another exemplary embodiment of the present invention, a lamp driving circuit includes a first circuit part including a first terminal, a second terminal and a first coil. A first end portion of the first coil is electrically connected to the first voltage supply part through the first terminal, and a second end portion of the first coil is electrically connected to the second voltage supply part through the second terminal. The lamp driving circuit further includes a second circuit part including a second coil electromagnetically coupled to the first coil and which supplies a voltage to a lamp, an inverter part which converts a DC voltage to a first AC voltage and a second AC voltage based on a control signal and outputs the first AC voltage to the first terminal of the first circuit part and outputs the second AC voltage to the second terminal of the first circuit part, an electric current detecting part which detects an electric current of the first coil and comprises a detecting resistor having a first end portion and a second end portion and an electric current detector, the first end portion of the detecting resistor being electrically connected to the first and second terminals of the first circuit part, and the second end portion of the detecting resistor being electrically connected to ground and a control part electrically connected to the electric current detecting part and which outputs the control signal to the inverter part.

A plurality of the second coils of the second circuit part may be electromagnetically coupled to the first coil.

The lamp of the second circuit may include a CCFL.

According to exemplary embodiments of the present invention, a lamp current is detected without any additional components and/or circuits. Thus, a manufacturing cost of an electric current detecting circuit may be decreased.

BRIEF DESCRIPTION OF THE DRAWINGS

The above and other aspects, features and advantages of the present invention will become more apparent by describing in further detail exemplary embodiments thereof with respect to the accompanying drawings, in which.

DETAILED DESCRIPTION OF THE INVENTION

Figure 1:
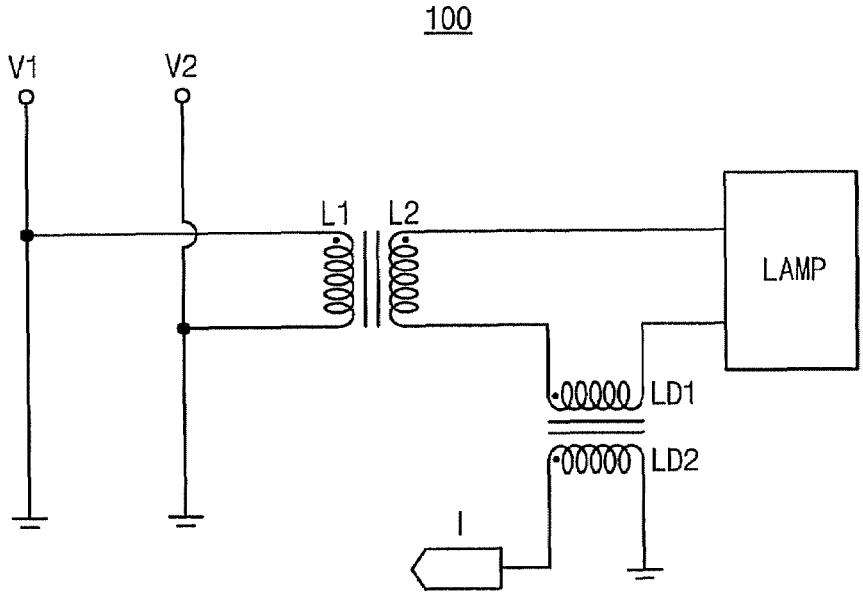
FIG. 1 is a schematic circuit diagram illustrating a lamp driving circuit in accordance with a first exemplary embodiment of the present invention.

The invention will now be described more fully hereinafter with reference to the accompanying drawings, in which exemplary embodiments of the invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Exemplary embodiments of the present invention are described herein with reference to cross section illustrations which are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes which result, for example, from manufacturing. For example, a region illustrated or described as flat may, typically, have rough and/or nonlinear features. Moreover, sharp angles which are illustrated may be rounded. Thus, the regions illustrated in the figures are schematic in nature and their shapes are not intended to illustrate the precise shape of a region and are not intended to limit the scope of the present invention.

Hereinafter, exemplary embodiments of the present invention will be described in further detail with reference to the accompanying drawings.

FIG. 1 is a schematic circuit diagram illustrating a lamp driving circuit in accordance with a first exemplary embodiment of the present invention.

Referring to FIG. 1, a lamp driving circuit 100 includes a first voltage supply part V1, a second voltage supply part V2, a first coil L1, a second coil L2, a lamp, a first detecting coil LD1, a second detecting coil LD2 and an electric current detector I. In an exemplary embodiment of the present invention, the lamp may be a cold cathode fluorescent lamp ("CCFL") in a liquid crystal display ("LCD"), for example, but is not limited thereto in alternative exemplary embodiments.

A first end of the first coil L1 is electrically connected to the first voltage supply part V1 and a second end of the first coil L1 is electrically connected to the second voltage supply part V2. The first coil L1 and the second coil L2 are electromagnetically coupled to each other. The lamp is electrically connected to a first end of the second coil L2 and a first end of the first detecting coil LD1, and is driven by power from the second L2 coil. A second end of the first detecting coil LD1 is electrically connected to a second end of the second coil L2 and the first end of the first detecting coil LD1 is electrically connected to the lamp, as described above. A first end of the second detecting coil LD2 is electrically connected to ground. The electric current detector I is electrically connected to a second end of the second detecting coil LD2. The electric current detector I detects an electric current from the second detecting coil LD2, which is electromagnetically coupled to the first detecting coil LD1.

In the first exemplary embodiment of the present invention, the electric current detected by the electric current detector I is used to protect the lamp and to reduce electromagnetic interference ("EMI").

Figure 2:
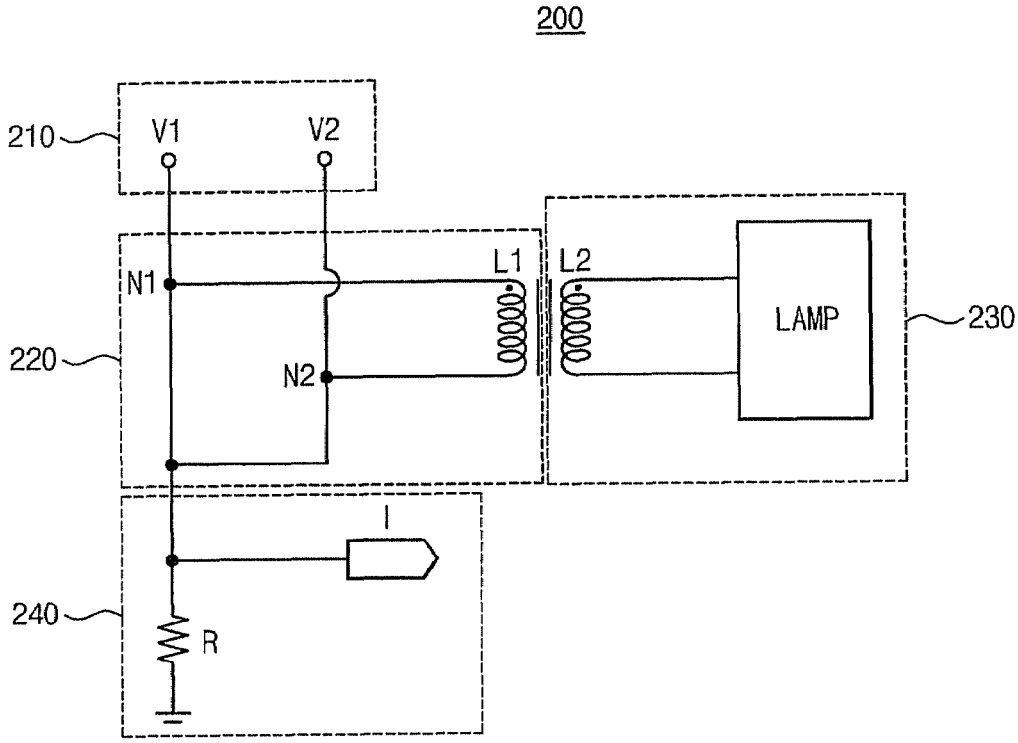
FIG. 2 is a schematic circuit diagram illustrating a lamp driving circuit in accordance with a second exemplary embodiment of the present invention.

FIG. 2 is a schematic circuit diagram illustrating a lamp driving circuit in accordance with a second exemplary embodiment of the present invention.

Referring to FIG. 2, a lamp driving circuit 200 includes a voltage supply part 210, a first circuit part 220, a second circuit part 230 and an electric current detecting part 240. The voltage supply part 210 includes a first voltage supply part V1 and a second voltage supply part V2. The first circuit part 220 includes a first coil L1, a first terminal N1 and a second terminal N2. The second circuit part 230 includes a second coil L2 and a lamp. The electric current detecting part 240 includes a detecting resistor R and an electric current detector I.

The first voltage supply part V1 of the voltage supply part 210 is electrically connected to a first end of the first coil L1 through the first terminal N1 of the first circuit part 220. The second voltage supply part V2 of the voltage supply part 210 is electrically connected to a second end of the first coil L1 through the second terminal N2. The first coil L1 of the first circuit part 220 is electromagnetically coupled to the second coil L2 of the second circuit part 230. The first coil L1 induces an electric signal in the second coil L2 of the second circuit part 230 based on the voltage supply part 210. The lamp is electrically connected to a first end and a second end of the second coil L2, and the electric signal induced in the second coil L2 drives the lamp.

The first terminal N1 and the second terminal N2 of the first circuit 220 are electrically connected to a first end of the detecting resistor R of the electric current detecting part 240. A second end of the detecting resistor R is electrically connected to ground. The electric current detector I is electrically connected to the first end of the resistor R. The electric current detector I detects an electric current flowing from the first circuit part 220 through the detecting resistor R.

Figure 3:
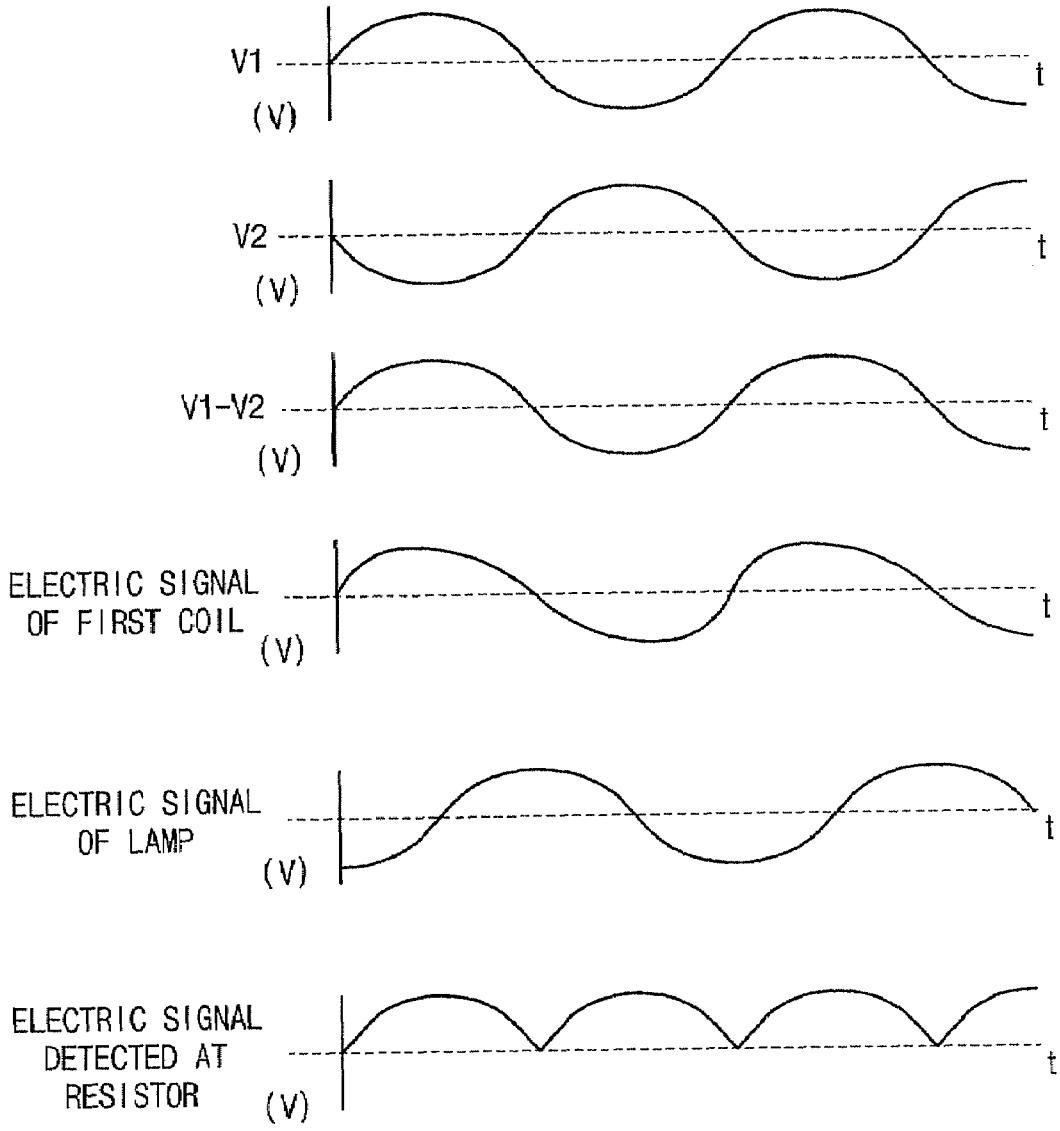
FIG. 3 is a graph of voltage versus time illustrating signals of the lamp driving circuit in accordance with the second exemplary embodiment of the present invention in FIG. 2.

FIG. 3 is a graph of voltage versus time illustrating signals of the lamp driving circuit in accordance with the second exemplary embodiment of the present invention in FIG. 2.

Referring to FIGS. 2 and 3, a supply voltage of the first voltage supply part V1 and a supply voltage of the second voltage supply part V2 of the voltage supply part 210 may be alternating current ("AC") voltages having opposite phases to each other. A first input voltage is applied to the first voltage supply part V1, and a second input voltage is applied to the second voltage supply part V2. An electric signal is generated at and flows through the first coil L1 of the first circuit part 220 due to a voltage difference between the first input voltage and the second input voltage, e.g., V1−V2, as shown in FIG. 3. In addition, an electric signal is generated at the second coil L2 electromagnetically coupled to the first coil L1 and flows to the lamp. Finally, the current detector I detects an electric signal at the detecting resistor R.

Figure 4:
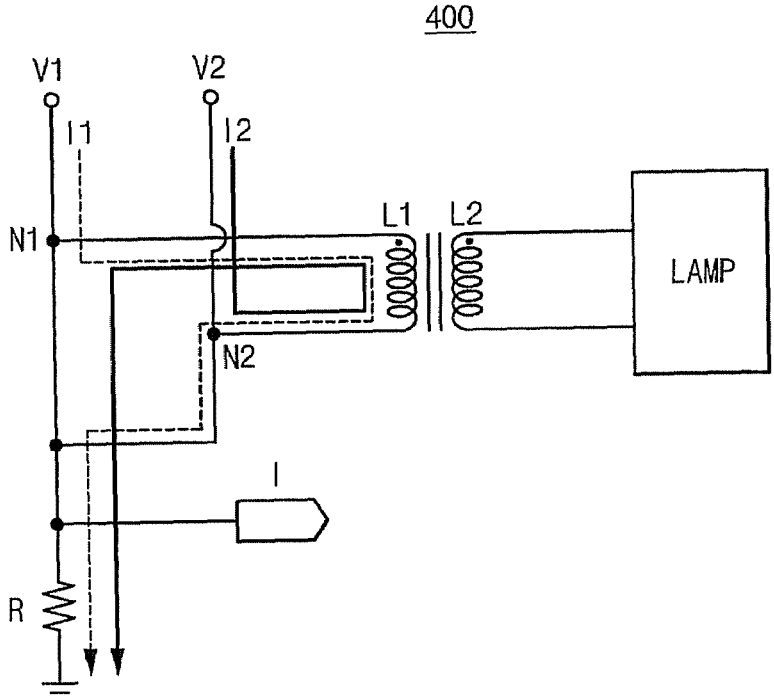
FIG. 4 is a schematic circuit diagram illustrating an electric current flow in the lamp driving circuit in accordance with the second exemplary embodiment of the present invention in FIG. 2.

FIG. 4 is a schematic circuit diagram illustrating an electric current flow in the lamp driving circuit in accordance with the second exemplary embodiment of the present invention in FIG. 2.

Referring to FIGS. 2 and 4, AC voltages having opposite phases to each other are applied to the lamp driving circuit, e.g., a first input voltage is applied to the first voltage supply part V1 and a second input voltage is applied to the second voltage supply part V2. An electric current flows in a first direction when the first input voltage is greater than the second input voltage and in a second direction when the second input voltage is greater than the first input voltage.

More specifically, when the first input voltage is greater than the second input voltage, the first voltage supply part V1 has a relatively higher voltage than the first end (FIG. 2) of the first coil L1 and an electric current flows along a first path I1. As shown in FIG. 4, the electric current which flows along the first path I1 flows from the first voltage supply part V1 to the first coil L1 through the first terminal N1 of the first circuit part 220 (FIG. 2). Furthermore in this case, the second voltage supply part V2 has a relatively lower voltage than the second end (FIG. 2) of the first coil L1. Therefore, the electric current from the first coil L1 flows through the second terminal N2 and the electric signal from the second terminal N2 flows through the detecting resistor R to ground, as shown in FIG. 4.

Conversely, when the second input voltage is higher than the first input voltage, the second voltage supply part V2 has a relatively higher voltage than the first voltage supply part V1 and an electric current flows along a second path I2. Thus, as shown in FIG. 4, the electric current which flows along the second path I2 flows through the second voltage supply part V2 of the voltage supply device 210 (FIG. 2), the second terminal N2 of the first circuit part 220 (FIG. 2), the first coil L1, the first terminal N1 and the detecting resistor R of the electric current detecting part 240 (FIG. 2) to ground.

Therefore, even though an electric signal flows along either a direction of the first flow I1 or the second flow I2 in the first circuit part 220, a direction of the electric signal flowing through the detecting resistor R of the electric current sensing part 240 is constant, regardless of the voltage difference between and/or the respective polarities of the first input voltage and the second input voltage. In a conventional electric signal detecting method, an electric signal flowing through a detecting resistor has substantially the same pattern as an electric signal flowing through a first coil and a second coil, and the electric signal needs to be integrated by an integration circuit. However, since the direction of the electric signal in the current detecting part 240 described above is constant, an integrated electric signal may be obtained without the integration circuit, reducing complexity and manufacturing cost of a lamp driving circuit according to the second exemplary embodiment of the present invention.

Referring again to FIG. 3, the first input voltage of the first voltage supply part V1 (FIG. 2) and the second input voltage of the second supply voltage part V2 (FIG. 2) of the voltage supply device 210 (FIG. 2) are illustrated. The voltage difference of the first input voltage and the second input voltage, e.g., V1−V2, drives the first coil L1 (FIG. 2) of the first circuit part 220 (FIG. 2). The first coil L1 of the first circuit part 220 and the second coil L2 of the second circuit part 230 (FIG. 2) are electromagnetically coupled to each other, and an electric signal is induced in the second coil L2. The electric signal induced in the second coil L2 drives the lamp.

The electric current detector I (FIG. 2) detects the electric signal flowing through the detecting resistor R, via the first coil L1, which is proportional to the electric signal of the second coil L2 driving the lamp according to Faraday's law of induction, to monitor a driving condition of the lamp. When an overcurrent or an undercurrent flows through the lamp, an abnormal current condition is detected, and a driving of the lamp is controlled based on the electric signal detected by the electric current detector such that the abnormal current condition is effectively reduced or substantially eliminated and a constant current is supplied to the lamp.

The electric signal of the first circuit part 220 which is detected by the electric current detecting part may have an error compared with the electric signal of the second circuit part 230 which drives the lamp, but the error is negligible with regard to the magnitude of the electric signal of the second circuit part 230 which drives the lamp.

As described above, a detected signal at the detecting resistor R of the electric current detecting part 240 (FIG. 2) always a positive value, e.g., always flows in a constant direction, and an extra integration circuit may be omitted from a lamp driving circuit in accordance with the second exemplary embodiment of the present invention. Moreover, the electric signal detected at the detecting resistor R of the electric current detecting part 240 is substantially proportional to the electric signal of the first circuit part 220, and the electric signal of the first circuit part 220 is substantially proportional to the electric signal of the second circuit part 230 according to Faraday's law of induction. Therefore, the electric signal of the lamp is accurately detected at the detecting resistor R in accordance with the second exemplary embodiment of the present invention.

Figure 5:
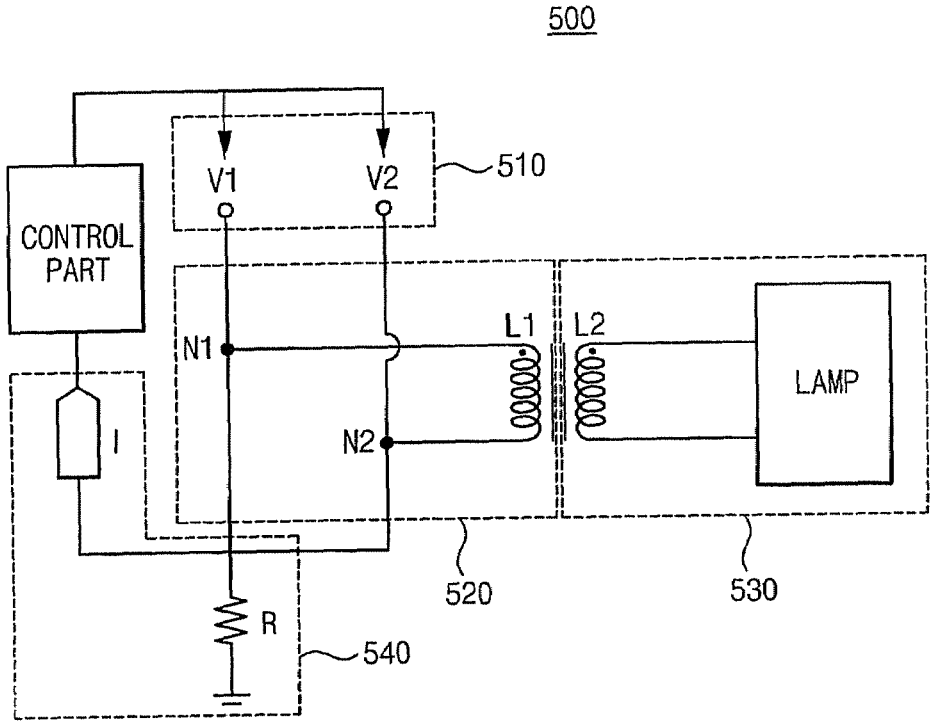
FIG. 5 is a schematic circuit diagram illustrating a lamp driving circuit in accordance with a third exemplary embodiment of the present invention.

FIG. 5 is a schematic circuit diagram illustrating a lamp driving circuit in accordance with a third exemplary embodiment of the present invention.

Referring to FIG. 5, a lamp driving circuit 500 includes a voltage supply part 510, a first circuit part 520, a second circuit part 530, an electric current detecting part 540 and a control part. The voltage supply part 510 includes a first voltage supply part V1 and a second voltage supply part V2. The first circuit part 520 includes a first coil L1, a first terminal N1 and a second terminal N2. The second circuit 530 includes a second coil L2 and a lamp. The electric current detecting part 540 includes a detecting resistor R and an electric current detector I.

The lamp driving circuit 500 of FIG. 5 is substantially the same as the lamp driving circuit 200 according to the second exemplary embodiment of the present invention in FIG. 2 except for the control part. Thus, any repetitive explanation concerning the above elements of the lamp driving circuit 500 will be omitted hereinafter. Further referring to FIG. 5, the control part is connected to the electric current detector I and the voltage supply part 510 and controls input voltages (not shown) corresponding to the first voltage supply part V1 and the second voltage supply part V2, as discussed in greater detail above, based on a detected electric signal. The detected electric signal is detected by the electric current detector I of the electric current detecting part 540. When the detected electric signal is over-supplied, the input power is reduced by the control part. When the detected electric signal is under-supplied, the input power is increased by the control part. A method of controlling the control part, discussed in further detail later, may vary a duration of supplied power and/or an amount of supplied power, for example, but is not limited thereto.

Figure 6:
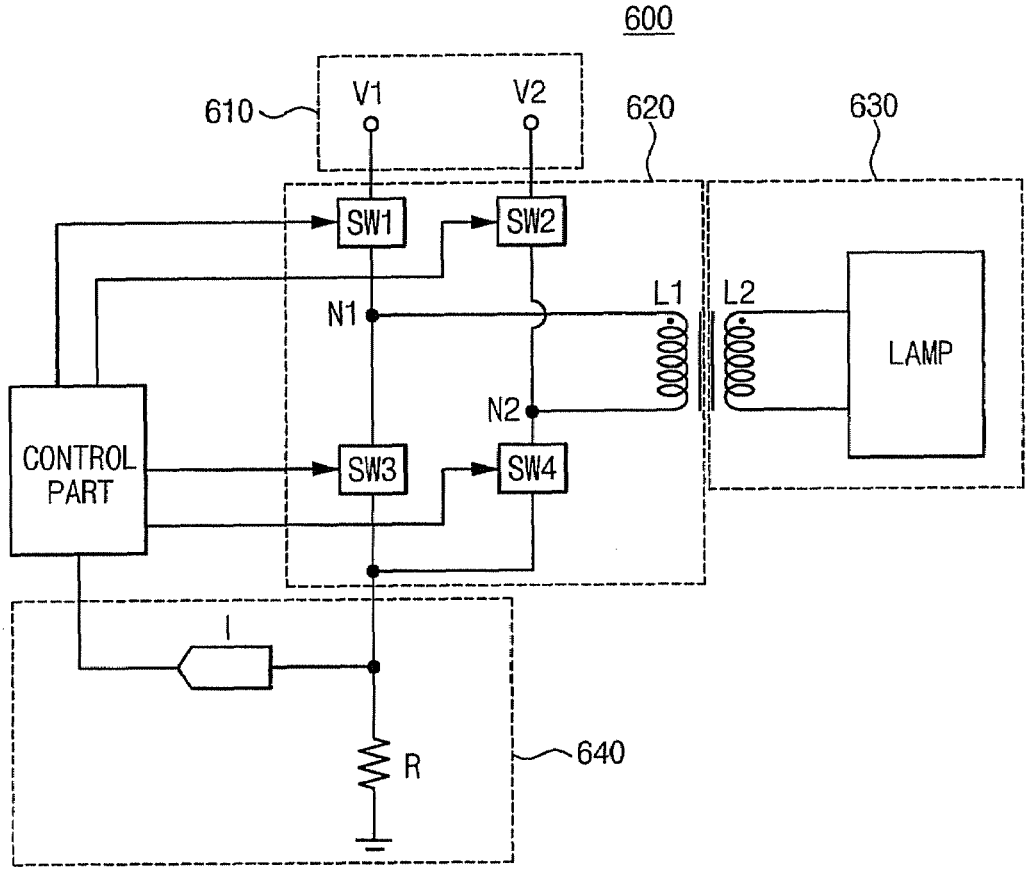
FIG. 6 is a schematic circuit diagram illustrating a lamp driving circuit in accordance with a fourth exemplary embodiment of the present invention.
Figure 7:
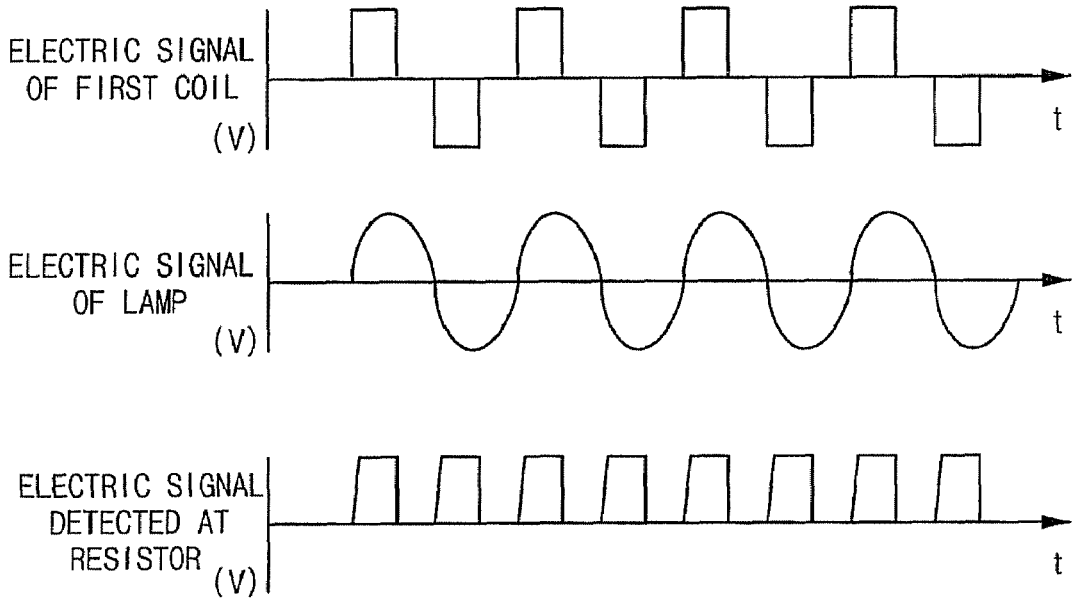
FIG. 7 is a timing diagram illustrating signals of the lamp driving circuit in accordance with the fourth exemplary embodiment of the present invention in FIG. 6.

FIG. 6 is a schematic circuit diagram illustrating a lamp driving circuit in accordance with a fourth exemplary embodiment of the present invention. FIG. 7 is a timing diagram illustrating signals applied the lamp driving circuit in accordance with the fourth exemplary embodiment of the present invention in FIG. 6.

Referring to FIG. 6, a lamp driving circuit 600 includes a voltage supply part 610, a first circuit part 620, a second circuit part 630, an electric current detecting part 640 and a control part. The voltage supply device 610 includes a first voltage supply part V1 and a second voltage supply part V2. The first circuit part 620 includes a first coil L1, a first terminal N1, a second terminal N2, a first switch SW1, a second switch SW2, a third switch SW3 and a fourth switch SW4. The second circuit part 630 includes a second coil L2 and a lamp. The electric current detecting part 640 includes a detecting resistor R and an electric current detector I.

The first voltage supply part V1 of the voltage supply device 610 is electrically connected to an input of the first switch SW1 of the first circuit part 620. An output of the first switch SW1 of the first circuit part 620 is electrically connected to the first terminal N1. The first terminal N1 of the first circuit part 620 is electrically connected to a first end of the first coil L1 and an input of the third switch SW3. The first terminal N1 supplies a first input voltage (not shown) of the first voltage supply part V1. The second voltage supply part V2 is electrically connected to an input of the second switch SW2, and an output of the second switch SW2 of the first circuit part 620 is electrically connected to the second terminal N2. The second terminal N2 of the first circuit part 620 is electrically connected to a second end of the first coil L1, an output of the second switch SW2 and an input of the fourth switch SW4 of the second circuit part 630. The second terminal N2 supplies a second input voltage of the second voltage supply part V2.

An output of the third switch SW3 is electrically connected to a first end of the electric current detector I and a first end of the detecting resistor R of the electric current detecting part 640. Similarly, the output of the fourth switch SW4 of the first circuit part 620 is electrically connected to the first end of the electric current detector I and the first end of the detecting resistor R of the electric current detecting part 640.

A second end of the detecting resistor R of the electric current detecting part 640 is electrically connected to ground. A second end of the electric current detector I is electrically connected to an input of the control part. Outputs of the control part are electrically connected to corresponding control inputs of the first, second, third and fourth switches SW1, SW2, SW3 and SW4, respectively, and control the first, second, third and fourth switches SW1, SW2, SW3 and SW4, respectively.

Further referring to FIGS. 6 and 7, supply voltages of a first voltage supply part V1 and a second voltage supply part V2 of a lamp driving circuit 600 of FIGS. 6 and 7, for example, may be a direct current (DC) voltage, but are not limited thereto. The DC voltage is applied based on the first voltage supply part V1 and the second voltage supply part V2 of the voltage supply device 610. The first and third switches and the second and fourth switches are alternately turned on and off. The first and third switches and the second and fourth switches discontinuously supply DC voltage power. For example, a voltage having a waveform such as an electric signal of the first coil L1 of the first circuit part 620 of FIG. 7, may be supplied to the first coil L1, but is not limited thereto.

The first coil L1 and the second coil L2 are electromagnetically coupled to each other, and the lamp is electrically connected to the second coil L2, as shown in FIG. 6. The second coil L2 may include self-electromagnetic induction. When a supply voltage having a waveform such as an electric signal of the first coil shown in FIG. 7, for example, but not being limited thereto, is applied to the first coil L1, the electric signal of the lamp has a curved, e.g., substantially sinusoidal, shape as shown in FIG. 7. The curved, e.g., substantially sinusoidal, electric signal is applied to the lamp and drives the lamp. As discussed above, the electric signal of the lamp needs to be detected by the electric current detecting part 640 in order to adjust and/or control a current to the lamp.

The first coil L1 of the first circuit part 620 is driven by the supply voltage difference between the first voltage supply part V1 and the second voltage supply part V2, e.g., V1−V2. More specifically, the first voltage supply part V1 and the second voltage supply part V2 are controlled by the first, second, third and fourth switches SW1, SW2, SW3 and SW4, respectively, of the first circuit part 620. Further, an electric signal is applied to the detecting resistor R and the electric current detector I of the electric current detecting part 640 through the third and fourth switches SW3 and SW4 of the first circuit part 620 and the electric signal of the first coil L1 is detected by the electric current detector I of the electric current detecting part 640. Thus, the electric signal of the first coil L1 is applied to the control part electrically connected to the first, second, third and fourth switches SW1, SW2, SW3 and SW4, respectively, of the first circuit part 620.

The electric signal detected at the detecting resistor R is always a positive value, as discussed earlier and shown in FIG. 7. Further, the electric signal detected at the detecting resistor R has a discontinuous value according to the input power applied to the first coil L1. Since the electric signal detected at the detecting resistor R flows in a constant direction at the detecting resistor R of the electric current detecting part 640 regardless of a voltage difference between or polarities of the first voltage supply part V1 and the second voltage supply part V2, an additional integrating circuit may be omitted in the fourth exemplary embodiment of the present invention.

Still referring to FIG. 6, the control part receives the detected electric signal by the electric current detector I of the electric current detecting part 640. The control part is electrically connected to the first, second, third and fourth switches SW1, SW2, SW3 and SW4, respectively, of the first circuit part 620, as described above. The control part controls the first voltage supply part V1 and the second voltage supply part V2 through the first, second, third and fourth devices SW1, SW2, SW3 and SW4, respectively, based on the detected electric signal. The first, second, third and fourth switches SW1, SW2, SW3 and SW4, respectively, of the first circuit part 620 convert a DC input power to an AC power. The first, second, third and fourth switches SW1, SW2, SW3 and SW4, respectively, turn on and off to control the AC power based on the detected electric signal applied to the control part. A control function of the power supply, for example, may control an on-off time of the first voltage supply part V1 and the second voltage supply part V2, but is not limited thereto. In an alternative exemplary embodiment, the power supply may control a voltage level of the first voltage supply part V1 and the second voltage supply part V2, for example, but is not limited thereto.

Figure 8:
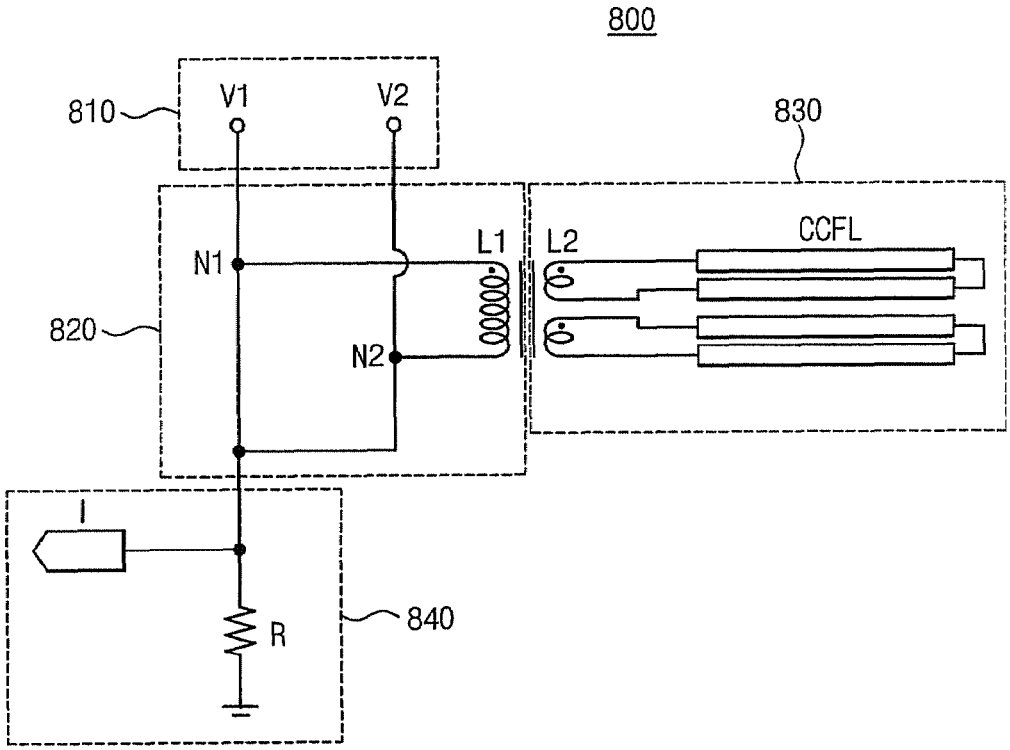
FIG. 8 is a schematic circuit diagram illustrating a lamp driving circuit in accordance with a fifth exemplary embodiment of the present invention.

FIG. 8 is a schematic circuit diagram illustrating a lamp driving circuit in accordance with a fifth exemplary embodiment of the present invention.

Referring to FIG. 8, a lamp driving circuit 800 includes a voltage supply device 810, a first circuit part 820, a second circuit part 830 and an electric current detecting part 840. The voltage supply device 810 includes a first supply device V1 and a second supply device V2. The first circuit part 820 includes a first coil L1, a first terminal N1 and a second terminal N2. The second circuit part 830 includes a plurality of second coils L2 and a plurality of cold cathode fluorescent lamps CCFL. The electric current part 840 includes a detecting resistor R and an electric current detector I.

The lamp driving circuit 800 of FIG. 8 is substantially the same as the lamp driving circuit 600 of FIG. 2 except that the lamp driving circuit 800 further includes a plurality of the second coils L2 and a plurality of the CCFLs. Thus, any repetitive explanation concerning elements described above will be omitted.

The first coil L1 of the first circuit part 820 in FIG. 8 is electromagnetically coupled to the plurality of the second coils L2. For example, the first coil L1 of the first circuit part 820 may be electrically connected to two second coils L2 of the plurality of second coils L2 of the second circuit part 830 as shown in FIG. 8, but is not limited thereto. Moreover, each of the two second coils L2 of the plurality of second coils L2 of the second circuit part 830 may be electrically connected to corresponding individual CCFLs of the plurality of the CCFLs, as illustrated in FIG. 8, for example, but is not limited thereto in alternate exemplary embodiments of the present invention.

Figure 9:
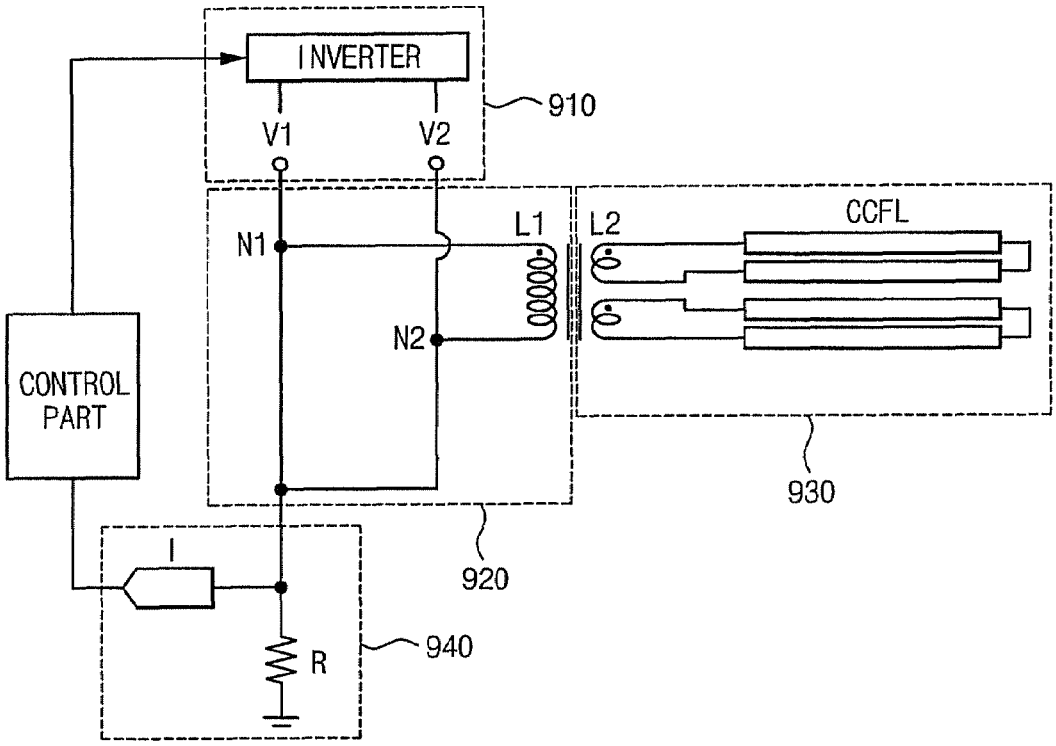
FIG. 9 is a schematic circuit diagram illustrating a lamp driving circuit in accordance with a sixth exemplary embodiment of the present invention.

FIG. 9 is a schematic circuit diagram illustrating a lamp driving circuit in accordance with a sixth exemplary embodiment of the present invention.

Referring to FIG. 9, a lamp driving circuit 900 includes an inverter part 910, a first circuit part 920, a second circuit part 930, an electric current detecting part 940 and a control part. The inverter part 910 includes an inverter a first voltage supply part V1 and a second voltage supply part V2. The first circuit part 920 includes a first coil L1, a first terminal N1 and a second terminal N2. The second circuit part 930 includes a plurality of second coils L2 and a plurality of cold cathode fluorescent lamps CCFL. The electric current detecting part 940 includes a detecting resistor R and an electric current detector I.

The lamp driving circuit 900 of FIG. 9 is substantially the same as the lamp driving circuit 800 of FIG. 5 except that the lamp driving circuit 900 further includes the inverter part 910. Thus, any repetitive explanation concerning elements described above will be omitted.

The inverter part 910 supplies an AC voltage in the lamp driving circuit 900, and extra switches are therefore unnecessary in the sixth exemplary embodiment of the present invention. As described in greater detail earlier, an electric current is detected by the electric current detector I of the electric current detecting part 940. Further, the control part directly controls the inverter 910 based on the detected electric current.

Figure 10:
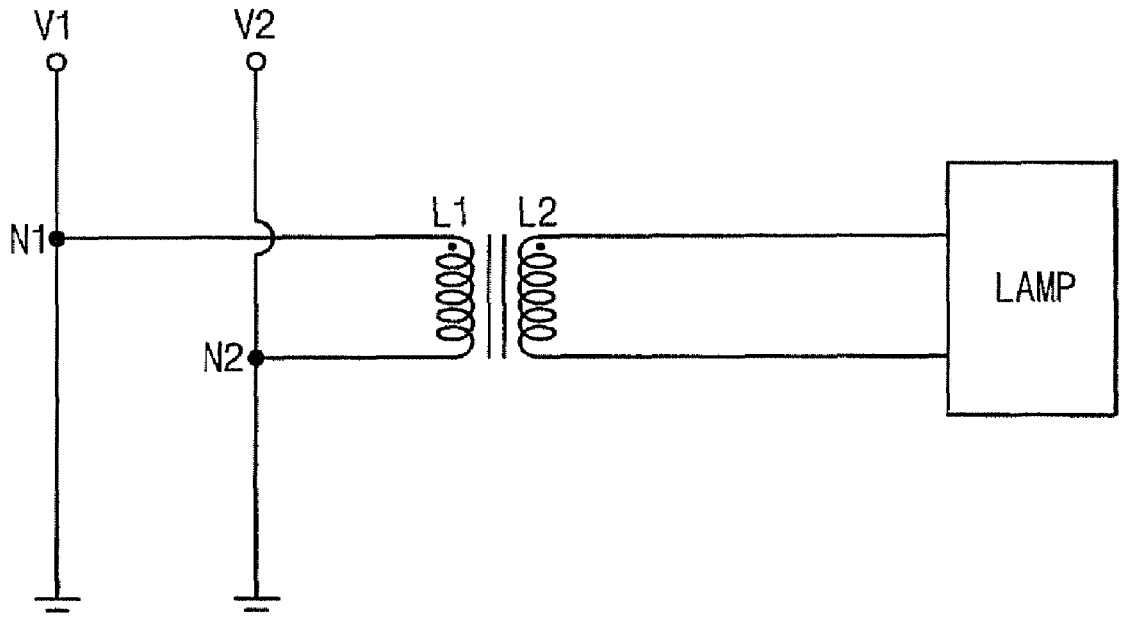
FIG. 10 is a schematic circuit diagram illustrating a lamp driving circuit in accordance with a seventh exemplary embodiment of the present invention.
Figure 11:
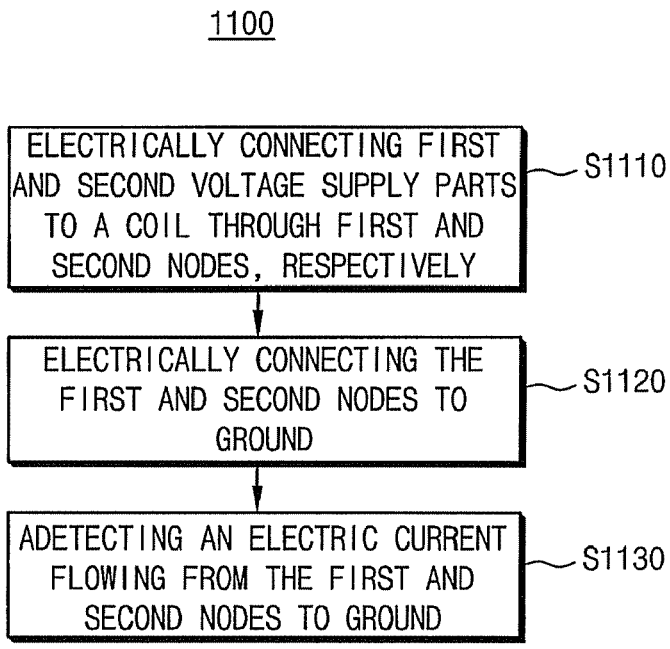
FIG. 11 is a flow chart illustrating a method for controlling the lamp driving circuit in accordance with the seventh exemplary embodiment of the present invention in FIG. 10.

FIG. 10 is a schematic circuit diagram illustrating a lamp driving circuit in accordance with a seventh exemplary embodiment of the present invention. FIG. 11 is a flow chart illustrating a method for controlling the lamp driving circuit in accordance with the seventh exemplary embodiment of the present invention in FIG. 10.

Referring to FIG. 10, a lamp driving circuit 1000 includes a first voltage supply part V1 and a second voltage supply part V2 which apply an electric power to a first coil L1. A second coil L2 is electromagnetically coupled to the first coil L1 and applies the electric power to a lamp to drive the lamp. Note that the present exemplary embodiment of the lamp driving circuit of FIG. 10 is related to a method of controlling the lamp driving circuit which will now be described in further detail.

Referring to FIGS. 10 and 11, in a method 1100 for controlling the lamp driving circuit 1000 of the seventh exemplary embodiment, a first terminal N1 which electrically connects a first voltage supply part V1 and a first coil L1 is electrically connected to a second terminal N2 which electrically connects a second voltage supply part V2 and the first coil N1 (step S1110). A contact point (not shown) of the first terminal N1 and the second terminal N2 is electrically connected to ground (step S1120). An electric current which flows through the first coil N1 between the contact point and ground is detected (step S1130).

When the first terminal N1 which receives a first supply voltage and is electrically connected to the first coil L1 is electrically connected to the second terminal N2 which receives a second supply voltage and is electrically connected to the first coil L1 (step S1110), an electric current flows through the first coil L1 due to a voltage difference between the first supply voltage and the second supply voltage. An electric current flows due to electromagnetic induction through a second coil L2 electromagnetically coupled to the first coil L1. The electric current of the second coil drives a lamp.

In order to detect a driving condition of the lamp, an electric current of the lamp needs to be detected. The second coil and the first coil are electromagnetically coupled. Thus, an electric current of the second coil and an electric current of the first coil are substantially proportional to each other according to Faraday's law of induction. Thus, the electric current of the second coil may be calculated and obtained by detecting the electric current of the first coil.

Moreover, the contact point of the first terminal N1 and the second terminal N2 is electrically connected to ground (step S1120). Therefore, the electric current of the first coil N1 flows to ground through the contact point regardless of a voltage difference or polarity between the first supply voltage and the second supply voltage.

Accordingly, when an electric current is detected between the contact point and the grounding part of the first terminal N1 and the second terminal N2 (step S1130), the detected electric current is used without requiring any additional circuits and/or processing.

Figure 12:
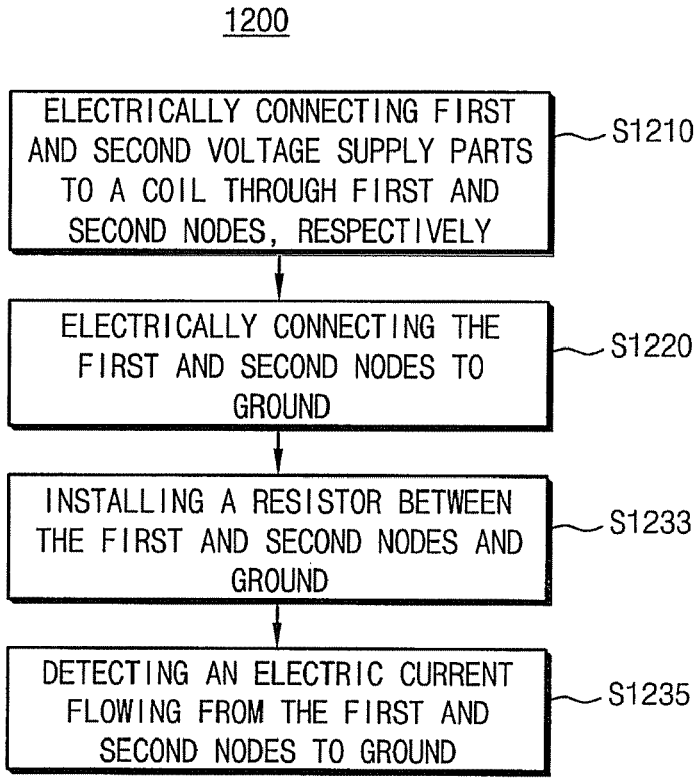
FIG. 12 is a flow chart illustrating a method for controlling a lamp driving circuit in accordance with an eighth exemplary embodiment of the present invention.

FIG. 12 is a flow chart illustrating a method for controlling a lamp driving circuit in accordance with an eighth exemplary embodiment of the present invention.

Referring to FIGS. 10 and 12, in a method 1200 of the eighth exemplary embodiment for controlling the lamp driving circuit 1000, the first terminal N1 which receives the first supply voltage and is electrically connected to the first coil L1, is electrically connected to the second terminal N2 which receives the second supply voltage and is electrically connected to the first coil L1 (step S1210). A contact point (not shown) of the first terminal N1 and the second terminal N2 is electrically connected to ground (step S1220). A resistor (not shown) is installed between the contact point and ground (step S1233). An electric current of the first coil L1 between the contact point and ground is detected (step S1235).

The method 1200 for controlling the lamp driving circuit 1000 is substantially the same as the method 1100 for controlling a lamp driving circuit of FIG. 11, except that the resistor is installed between the contact point and ground (step S1233). Thus, any repetitive explanation concerning the elements described above will be omitted.

The resistor is installed between the contact point and ground (step S1233). The electric current of the first coil L1 is detected calculated using a voltage of the resistor.

Figure 13:
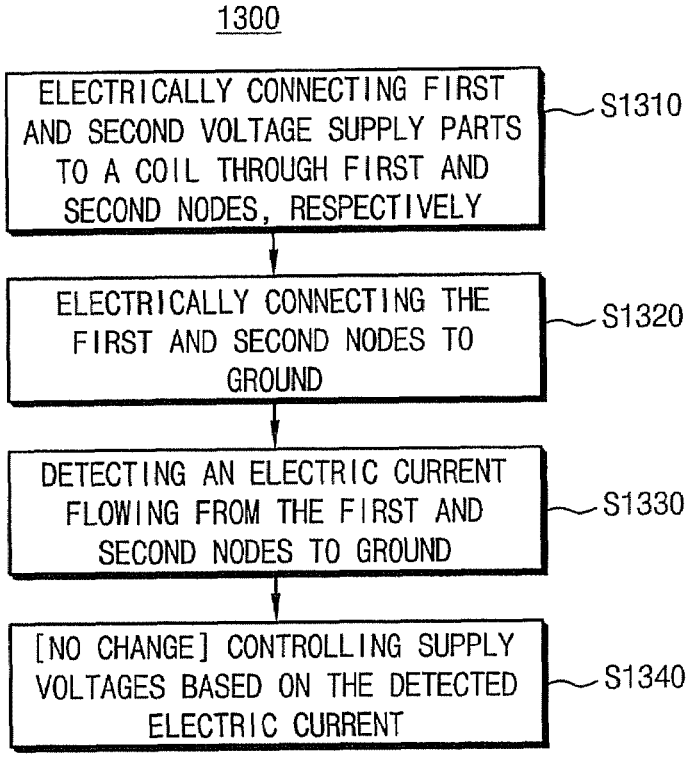
FIG. 13 is a flow chart illustrating a method for controlling a lamp driving circuit in accordance with a ninth exemplary embodiment of the present invention.

FIG. 13 is a flow chart illustrating a method for controlling a lamp driving circuit in accordance with a ninth exemplary embodiment of the present invention.

Referring to FIGS. 10 and 13, in the method 1300 of the ninth exemplary embodiment for controlling the lamp driving circuit 1000, the first terminal N1 which receives the first supply voltage and is electrically connected to the first coil L1, is electrically connected to the second terminal N2 which receives the second supply voltage and is electrically connected to the first coil L1 (step S1310). A contact point (not shown) of the first terminal N1 and the second terminal N2 is electrically connected to ground (step S1320). An electric current of the first coil L1 between the contact point and ground is detected (step S1330). The first supply voltage and the second supply voltage are controlled based on the detected electric current (step S1340).

The method 1300 for controlling the lamp driving circuit 1000 is substantially the same as the method 1100 for controlling a lamp driving circuit of FIG. 11, except for steps where the first supply voltage and the second supply voltage are controlled based on the detected electric current of the electric current part (step S1340). Thus, any repetitive explanation concerning the elements described above will be omitted.

The first supply voltage and the second supply voltage are controlled by the detected electric current. When the electric current driving the lamp is an overcurrent or an undercurrent, the control of the voltage supply based on the detected electric current is required in order to drive the lamp in a stable manner.

Figure 14:
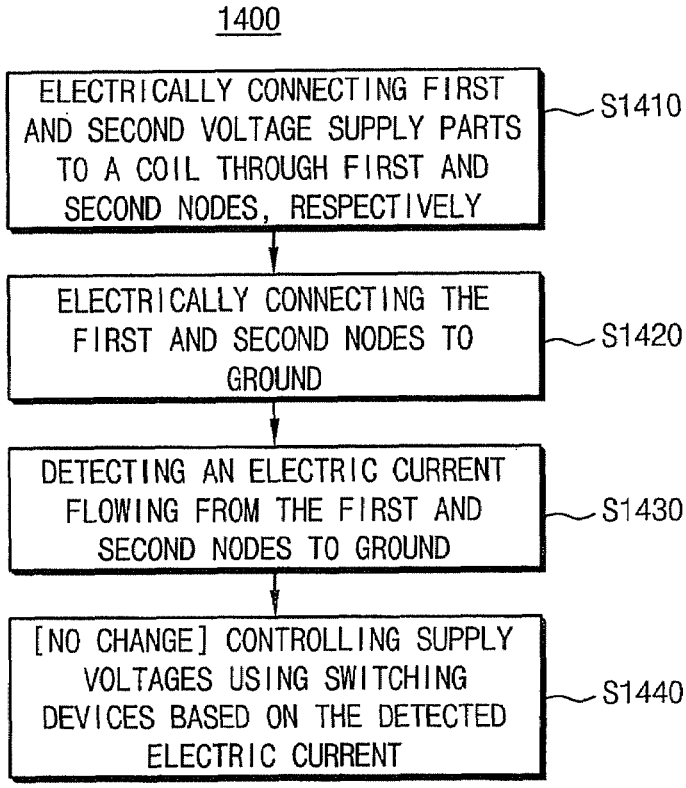
FIG. 14 is a flow chart illustrating a method for controlling a lamp driving circuit in accordance with a tenth exemplary embodiment of the present invention.

FIG. 14 is a flow chart illustrating a method 1400 for controlling a lamp driving circuit in accordance with a tenth exemplary embodiment of the present invention.

Referring to FIGS. 10 and 14, in the method 1400 in accordance with the tenth exemplary embodiment for controlling the lamp driving circuit 1000, the first terminal N1 which receives the first supply voltage and is electrically connected to the first coil L1, is electrically connected to the second terminal N2 which receives the second supply voltage and is electrically connected to the first coil L1 (step S1410). A contact point (not shown) of the first terminal N1 and the second terminal N2 is electrically connected to ground (step S1420). An electric current of the first coil L1 between the contact point and ground is detected (step S1430). The first supply voltage and the second supply voltage are controlled using switches based on the detected electric current of the electric current part (step S1440).

The method 1400 for controlling a lamp driving circuit is substantially the same as the method 1300 for controlling a lamp driving circuit of FIG. 13 except for steps where the first supply voltage and the second supply voltage are controlled based on the detected electric current of the electric current part using switches (step S1440). Thus, any repetitive explanation concerning the steps described above will be omitted.

A first switch (not shown) is installed at a first voltage supply part (not shown) which receives the first supply voltage, a second switch (not shown) is installed at a second voltage supply part (not shown) which receives the second supply voltage, a third switch (not shown) is installed at the first terminal N1 and a fourth switch (not shown) is installed at the second terminal N2. When the first supply voltage is controlled, the first switch and the third switch are turned on and off according to the detected electric current. When the second supply voltage is controlled, the second switch and the fourth switch are turned on and off according to the detected electric current.

Figure 15:
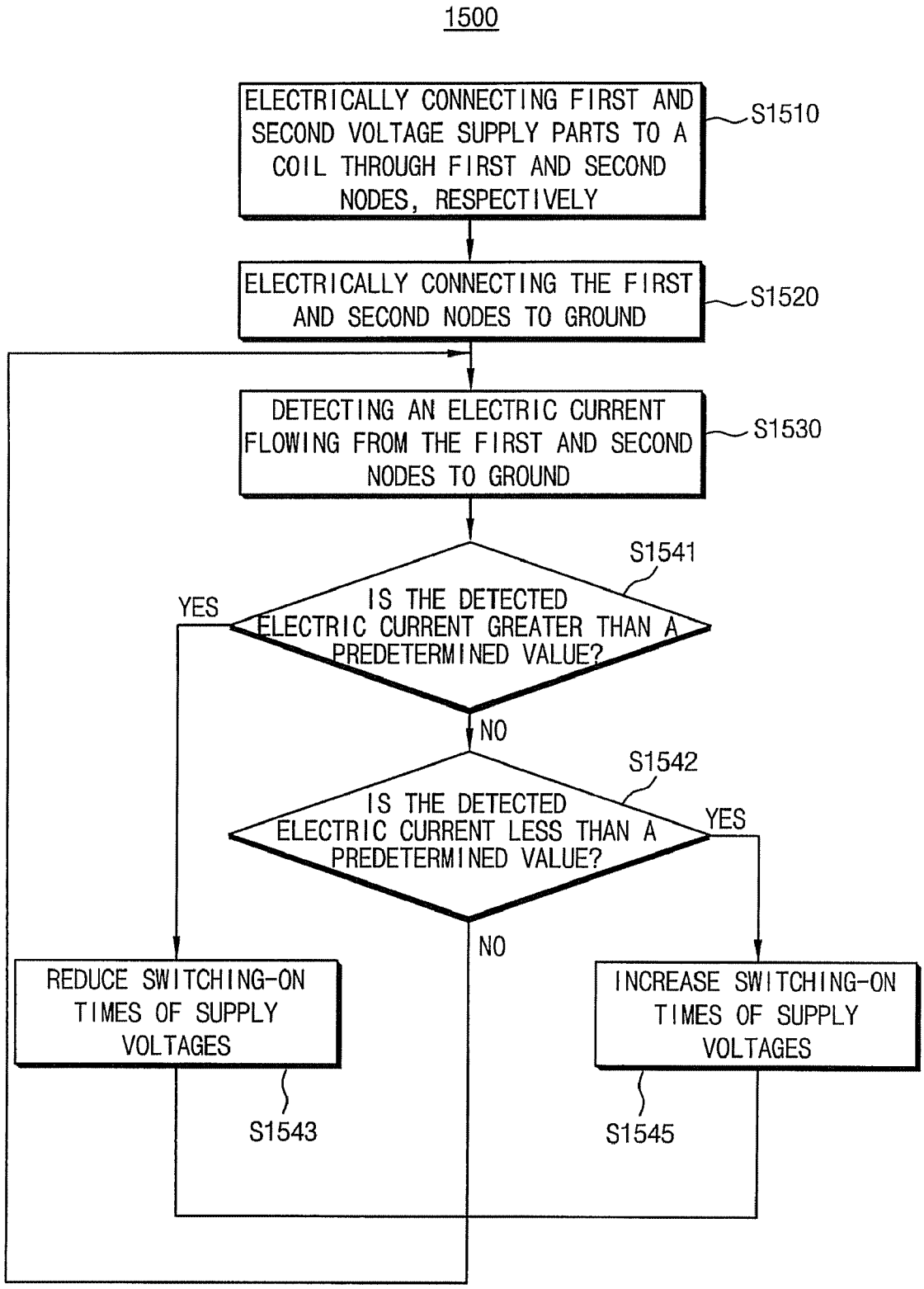
FIG. 15 is a flow chart illustrating a method for controlling a lamp driving circuit in accordance with an eleventh exemplary embodiment of the present invention.

FIG. 15 is a flow chart illustrating a method 1500 for controlling a lamp driving circuit in accordance with an eleventh exemplary embodiment of the present invention.

Referring to FIGS. 10 and 15, in the method 1500 in accordance with the eleventh exemplary embodiment for controlling the lamp driving circuit 1000, the first terminal N1 which receives the first supply voltage and is electrically connected to the first coil L1 is electrically connected to the second terminal N2 which receives the second supply voltage and is electrically connected to the first coil L1 (step S1510). A contact point (not shown) of the first terminal N1 and the second terminal N2 is electrically connected to ground (step S1520). An electric current of the first coil L1 between the contact point and ground is detected (step S1530). The detected electric current is compared to a designated range to determine whether the detected electric current is greater than a maximum value of the designated range (step S1541). A switching-on time of the first and second supply voltages is reduced when the detected electric current is greater than the maximum value of the designated range (step S1543). Similarly, the detected electric current is compared with the designated range to determine whether the detected electric current is less than a minimum value of the designated range (step S1542). The switching-on time of the first and second supply voltages is increased when the detected electric current is less than the minimum value of the designated range (step S1545).

The method 1500 for controlling a lamp driving circuit is substantially the same as the method 1400 for controlling a lamp driving circuit of FIG. 14 except for steps where the supply voltages are controlled according to cases in which the detected electric current is greater than or less than the maximum and/or minimum values of the designated range (steps S1541, S1542, S1543 and S1545). Thus, any repetitive explanation concerning the steps described above will be omitted.

To drive the lamp in a stable manner, a supplied electric current must be stable. Therefore, control of a lamp driving circuit is accomplished in a different manner at a given time depending on whether an over-supplied power case or an under-supplied power case exists at the given time.

When a detected electric current is greater than the maximum value of the designated range, first, second, third and fourth switches (not shown) reduce the switching-on time of the first and second supply voltages. When the detected electric current is less than the minimum value of the designated range, the first, second, third and fourth switches increase the switching-on time of the first and second supply voltages. Thus, a stable electric current is applied to a lamp, and the lamp generates light having a stable brightness.

As described herein, the lamp driving circuit in accordance with exemplary embodiments of the present invention detects an electric current of a lamp by adding an electric current detecting part at a first circuit, effectively reducing or eliminating the need for an additional detecting circuit in the lamp driving circuit. More specifically, a transformer and a diode circuit which integrate the detected electric current are not required, and therefore a manufacturing cost of the electric current detecting circuit is effectively decreased.

The present invention should not be construed as being limited to the exemplary embodiments set forth herein. Rather, these exemplary embodiments are provided so that this disclosure will be thorough and complete and will fully convey the concept of the present invention to those skilled in the art.

Therefore, those of ordinary skill in the art will appreciate that various changes, modifications, substitutions and variations may be made in form and detail to the present invention without departing from the spirit and scope thereof, as defined by the following claims.

What is claimed is:

1. A method for detecting a lamp current, the method comprising:

electrically connecting a first end portion of a first coil to a first supply voltage;

electrically connecting a second end portion of the first coil to a second supply voltage, the first coil being electromagnetically coupled to a second coil driving a lamp;

electrically connecting the first and second end portions of the first coil at a contact point;

connecting the contact point to ground; and detecting an electric current flowing from the contact point to ground.

2. The method of claim 1, wherein the electric current flowing from the contact point to ground is detected by:

installing a resistor between the contact point and ground; and detecting an electric current flowing through the resistor.

3. The method of claim 1, further comprising controlling the first supply voltage and the second supply voltage based on the detected electric current.

4. The method of claim 3, wherein the controlling the first supply voltage and the second supply voltage comprises:

installing a first switch at a first voltage supply part which supplies the first supply voltage, a second switch at a second voltage supply part which supplies the second supply voltage, a third switch at the first end portion of the first coil, and a fourth switch at the second end portion of the first coil; and controlling the first supply voltage and the second supply voltage according to the detected electric current by using the first, second, third and fourth switches.

5. The method of claim 4, wherein controlling the first supply voltage and the second supply voltage by using the first, second, third and fourth switches further comprises:

reducing a switching-on time of the first supply voltage and the second supply voltage when the detected electric current is greater than a predetermined value by using the first, second, third and fourth switches; and increasing the switching-on time of the first supply voltage and the second supply voltage by using the first, second, third and fourth switches when the detected electric current is less than the predetermined value.

6. A lamp driving circuit comprising:

a voltage supply part including a first voltage supply part and a second voltage supply part;

a first circuit part including a first terminal, a second terminal and a first coil, a first end portion of the first coil being electrically connected to the first voltage supply part through the first terminal, a second end portion of the first coil being electrically connected to the second voltage supply part through the second terminal;

a second circuit part including a second coil electromagnetically coupled to the first coil and which supplies a voltage to a lamp; and an electric current detecting part which detects an electric current of the first coil and includes a detecting resistor having a first end portion and a second end portion and an electric current detector, the first end portion of the detecting resistor being electrically connected to the first and second terminals of the first circuit part and the electric current detector, and the second end portion of the detecting resistor being electrically connected to ground.

7. The lamp driving circuit of claim 6, wherein a first supply voltage of the first voltage supply part and a second supply voltage of the second voltage supply part are alternating current (AC) voltages having phases opposite to each other.

8. The lamp driving circuit of claim 7, further comprising a supply voltage control part which controls the first supply voltage and the second supply voltage and is electrically connected between the electric current detecting part and the voltage supply part.

9. The lamp driving circuit of claim 6, further comprising:

a first switch installed between the first voltage supply part and the first terminal;

a second switch installed between the second voltage supply part and the second terminal;

a third switch installed between the first terminal and the first end portion of the detecting resistor;

and a fourth switch installed between the second terminal and the first end portion of the detecting resistor, wherein the first voltage supply part and the second voltage supply part of the voltage supply part comprise direct current (DC) voltage sources.

10. The lamp driving circuit of claim 9, further comprising a supply voltage control part which controls a first supply voltage of the first voltage supply part and a second supply voltage of the second voltage supply part and is electrically connected to the first, second, third and fourth switches.

11. The lamp driving circuit of claim 6, wherein the second circuit part further comprises a plurality of second coils electromagnetically coupled to the first coil.

12. The lamp driving circuit of claim 11, wherein the lamp of the second circuit part comprises a cold cathode fluorescent lamp (CCFL).

13. A lamp driving circuit comprising:

a first circuit part including a first terminal, a second terminal and a first coil, a first end portion of the first coil being electrically connected to a first voltage supply part through the first terminal, and a second end portion of the first coil being electrically connected to a second voltage supply part through the second terminal;

a second circuit part including a second coil electromagnetically coupled to the first coil and which supplies a voltage to a lamp;

an inverter part which converts a DC voltage to a first AC voltage and a second AC voltage based on a control signal and outputs the first AC voltage to the first terminal of the first circuit part and outputs the second AC voltage to the second terminal of the first circuit part;

an electric current detecting part which detects an electric current of the first coil and comprises a detecting resistor having a first end portion and a second end portion and an electric current detector, the first end portion of the detecting resistor being electrically connected to the first and second terminals of the first circuit part, and the second end portion of the detecting resistor being electrically connected to ground; and a control part electrically connected to the electric current detecting part and which outputs the control signal to the inverter part.

14. The lamp driving circuit of claim 13, wherein the second circuit part further comprises a plurality of the second coils electromagnetically coupled to the first coil.

15. The lamp driving circuit of claim 14, wherein the lamp of the second circuit comprises a cold cathode fluorescent lamp (CCFL).

* * * * *